US009468354B2

(12) United States Patent
Salmon

(10) Patent No.: US 9,468,354 B2
(45) Date of Patent: Oct. 18, 2016

(54) HOLDER FOR MOP HEADS

(75) Inventor: Dirk Salmon, Gilching (DE)

(73) Assignee: VERMOP SALMON GMBH, Gilching (DE)

( * ) Notice: Subject to any disclaimer, the term of this patent is extended or adjusted under 35 U.S.C. 154(b) by 0 days.

(21) Appl. No.: 14/415,174

(22) PCT Filed: Jul. 16, 2012

(86) PCT No.: PCT/EP2012/063887
§ 371 (c)(1),
(2), (4) Date: Jan. 16, 2015

(87) PCT Pub. No.: WO2014/012569
PCT Pub. Date: Jan. 23, 2014

(65) Prior Publication Data
US 2015/0208894 A1 Jul. 30, 2015

(51) Int. Cl.
*A47L 13/258* (2006.01)
*A47L 13/253* (2006.01)

(52) U.S. Cl.
CPC ..... *A47L 13/258* (2013.01); *A47L 13/253* (2013.01)

(58) Field of Classification Search
CPC ... A47L 13/258; A47L 13/253; A47L 13/20; A47L 13/256
See application file for complete search history.

(56) References Cited

U.S. PATENT DOCUMENTS 5,218,734 A * 6/1993 Sacks ..... A47L 13/258 15/147.1

FOREIGN PATENT DOCUMENTS

| | | | |
|---|---|---|---|
| CH | 691566A5 | A5 | 8/2001 |
| DE | 29519320U1 | U1 | 1/1996 |
| EP | 1764024B1 | B1 | 9/2008 |

OTHER PUBLICATIONS

International Search Report, dated Jul. 16, 2013, with respect to International Application No. PCT/EP2012/063887.
English Translation of International Preliminary Report on Patentability, dated Jul. 30, 2014, with respect to International Application No. PCT/EP2012/063887.

* cited by examiner

*Primary Examiner* — Shay Karls
(74) *Attorney, Agent, or Firm* — Scott R. Cox

(57) ABSTRACT

Disclosed is a holder for holding cleaning tool heads, particularly mop heads, including a central section, two latchable folding wings, which are pivotably mounted on the central section, a latching device to latch the two folding wings in a pivoted position in relation to the central section, and a device for releasing the latching of the latched folding wings in relation to the central section, such that said folding wings can be pivoted. The latching device is preloaded to the state in which the two folding wings are latched in such a manner that, when the latching is released, the holder automatically latches the folding wings by means of the latching device when the two folding wings are moved to a state in which the lower surfaces of the two folding wings are substantially in one plane.

13 Claims, 6 Drawing Sheets

Figur 1
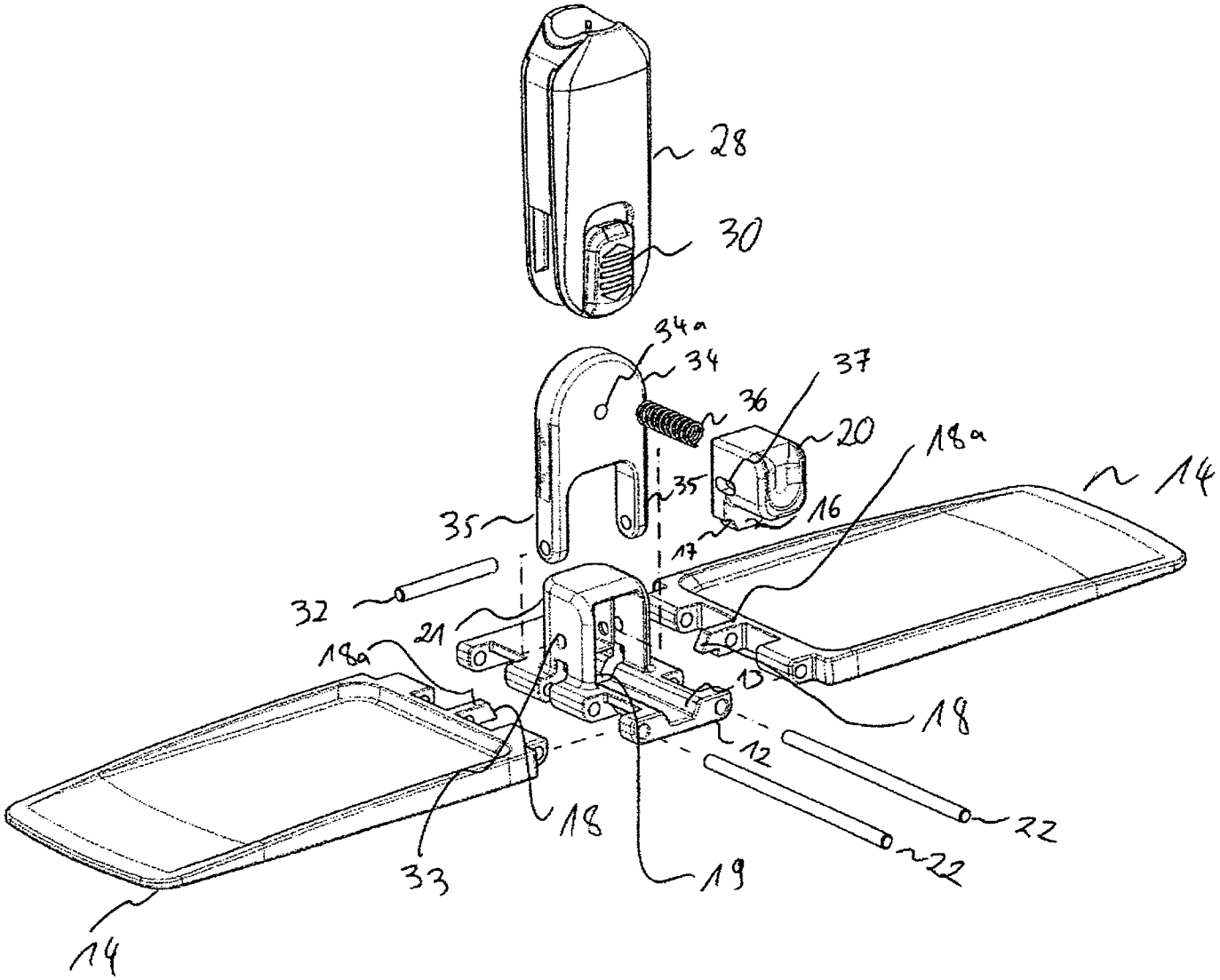

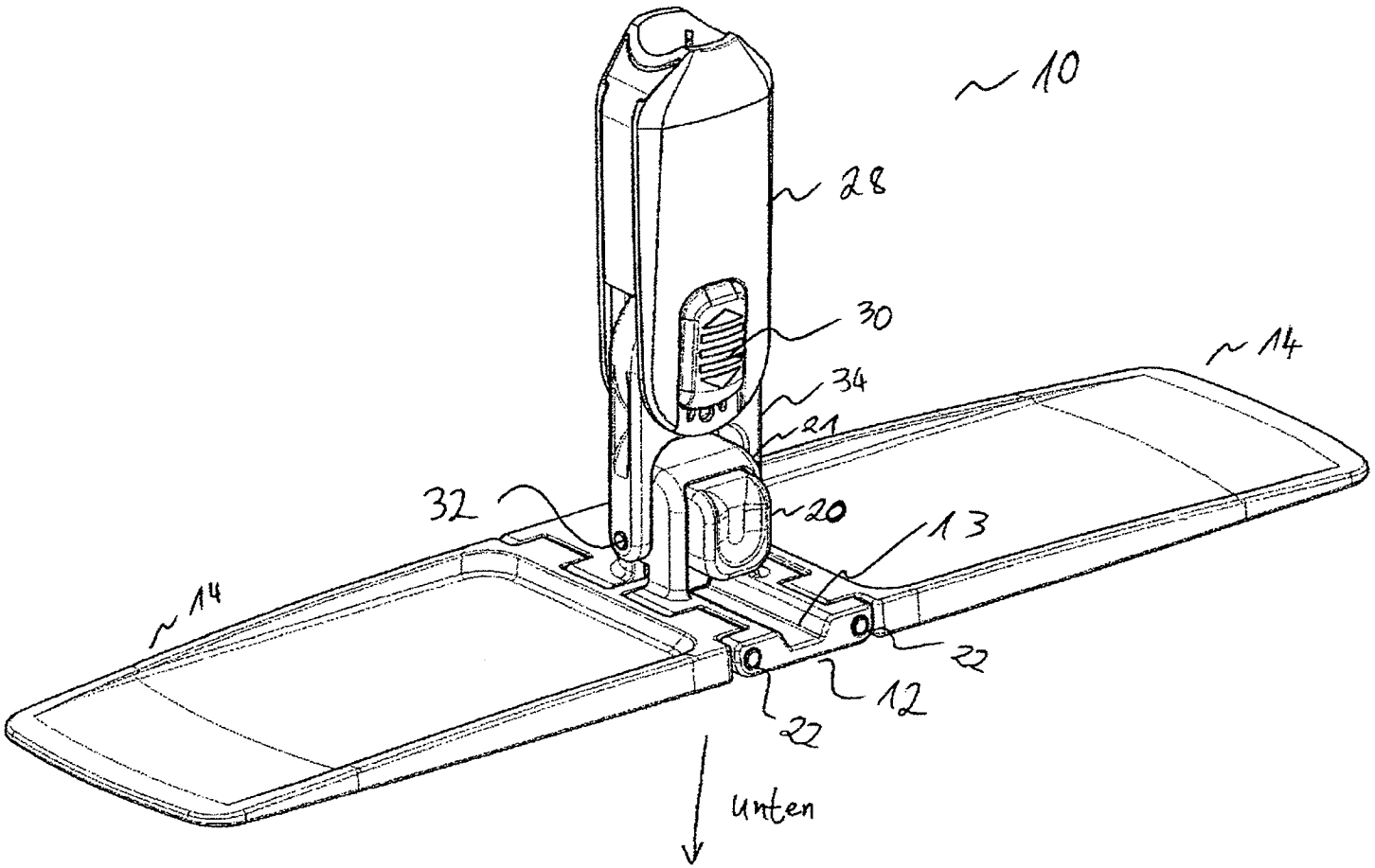
Figur 2

Figur3
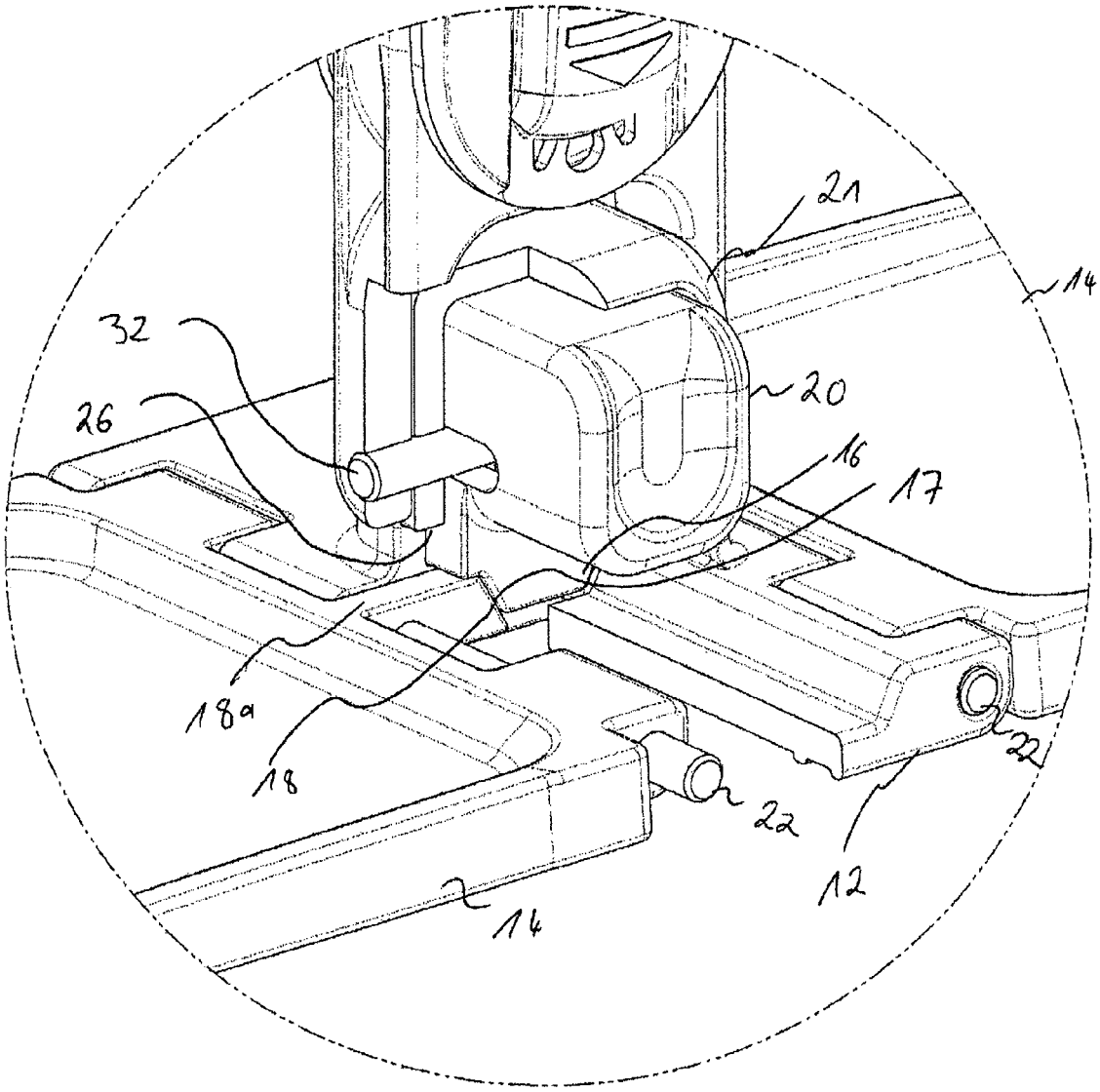

Figur 4
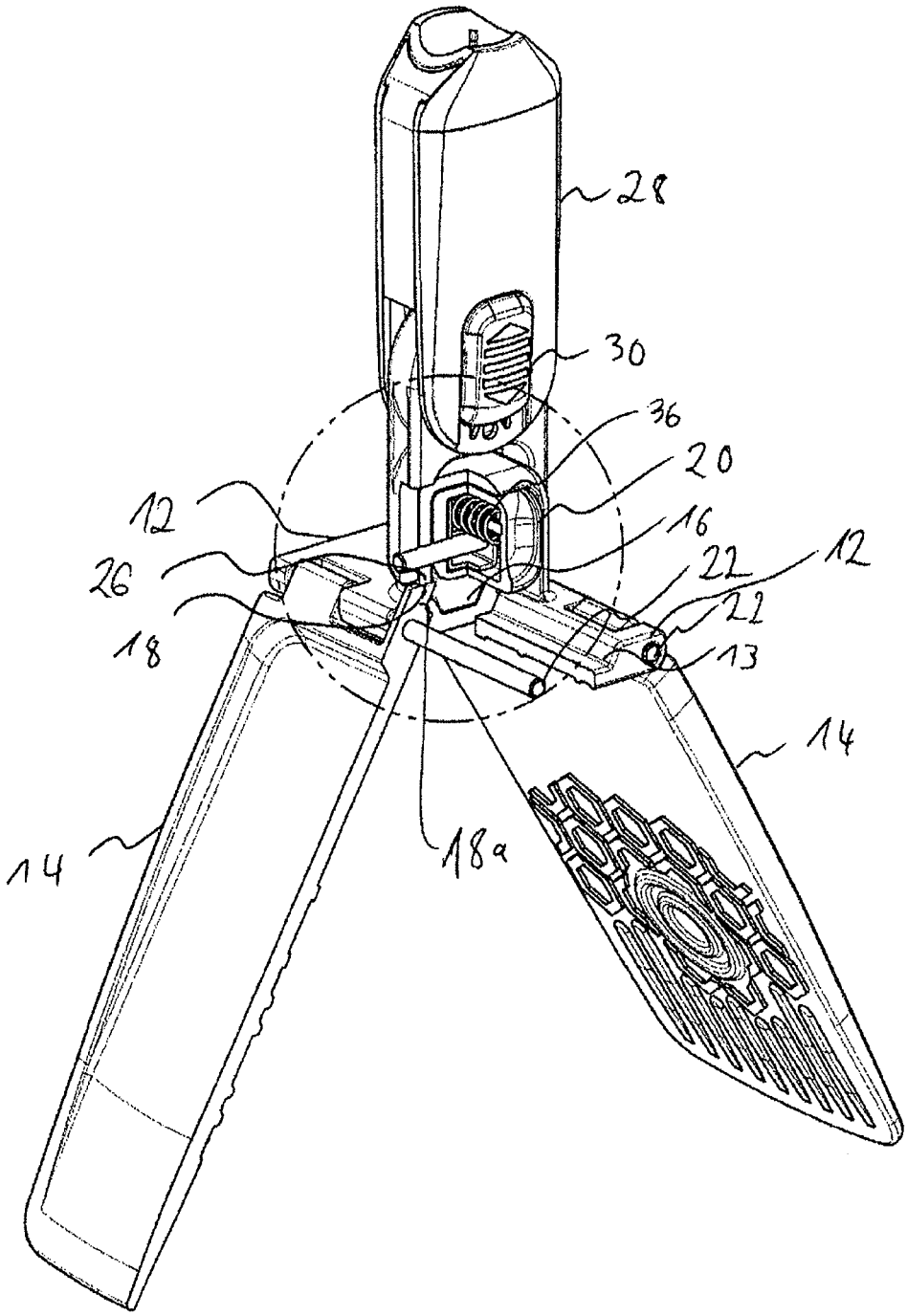

Figur 5
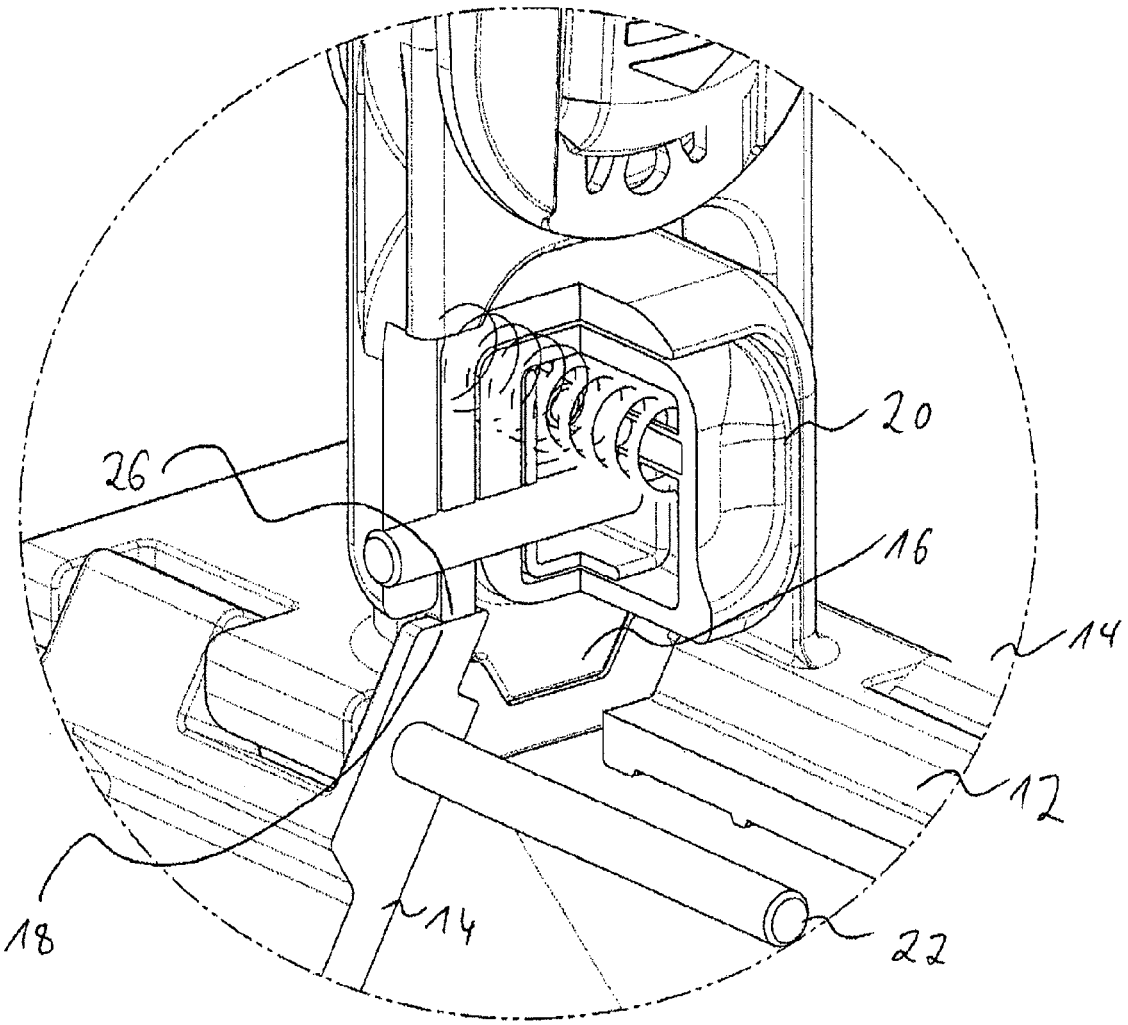

Figur 6
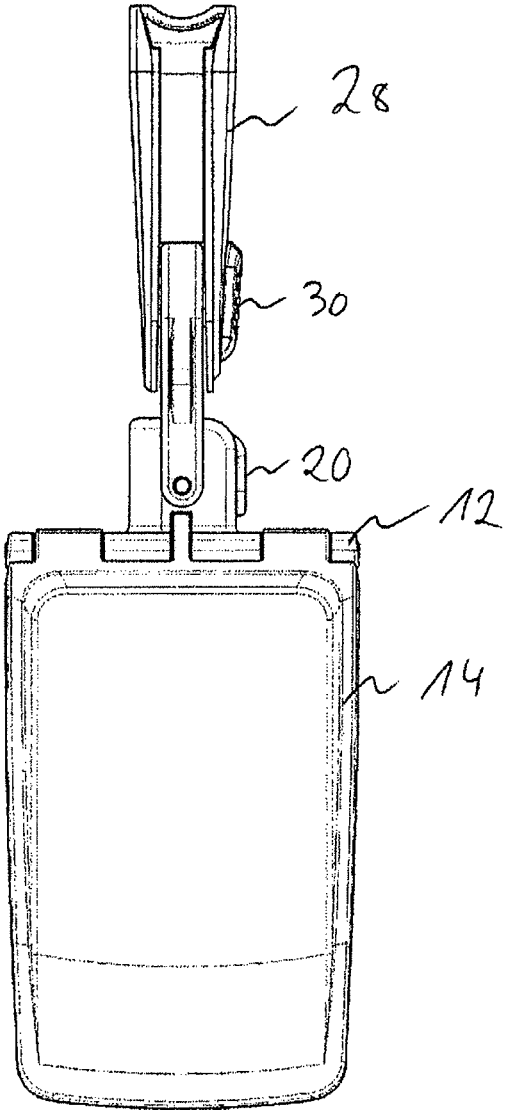

HOLDER FOR MOP HEADS

TECHNICAL FIELD

The present invention relates to a holder for mop heads.

TECHNICAL OBJECT

Mops are often used to clean large flat surfaces, such as, for example, linoleum floors, but also tiled areas such as those found in sanitary facilities or other rooms where importance is attached to a high degree of hygiene. A mop is a cleaning device comprising a base plate pivotably mounted on a long shaft.

On the opposite side when viewed from the shaft, a tool head is provided on this base plate (holder), which can be moved over the floor. This is clamped by the base plate and hence lies substantially taut thereon. Since, as a result, the shape of the tool head is defined by the base plate and this is substantially flat, the tool head also has a substantially flat surface. This can be wiped over the area to be cleaned thus enabling large floor areas to be effectively cleaned. This is particularly supported by the fact that the tool head is frequently provided with fringes that are normally up to approximately 10 cm long. The tool head can also be impregnated with water, which may also contain a cleaning agent whereby the cleaning effect is enhanced.

However, as is evident from the above, the problem is that, when in use, the tool head picks up dirt and as a result loses its cleaning effect after some time. A further problem is the wear of the tool head after a long period of use. However, since this applies solely to the tool head, but not to the base plate, it would not make sense to replace the tool head together with the base plate. Therefore, it is provided according to the prior art that the base plate and the tool head are designed such that the tool head is replaceable.

This is achieved according to the prior art in that the base plate is substantially provided in the shape of an elongated triangle, which can be folded together with respect to its longitudinal direction. As a result, the longitudinal edges are brought close together. In such a state, a correspondingly dimensioned tool head, with pockets on its longitudinal ends can be pushed over the longitudinal ends of the folded base plate. If this base plate is now transferred from the folded state into the flat state, the tool head is pulled straight by the pockets and the base plate and also held thereby, i.e. it is not able to slip off the base plate. However, at the same time, it is easy to remove the element from the base plate by re-folding the base plate.

However, one problem that occurs in this case is that it is desirable to prevent the base plate of the mop from folding together unintentionally since this could cause the tool head to fall off when in use. On the other hand, however, it is also desirable to have a mop with which the tool head is easy to replace when necessary and which, particularly in view of the high time pressure inter alia on cleaning companies, can be quickly replaced.

DESCRIPTION OF THE INVENTION

The present invention is directed at providing a holder for a mop that is designed such that the tool head is easy to replace.

One way of achieving this object is provided by the holder for holding cleaning tool heads according to claim 1. Preferred embodiments are described in the dependent claims 2 to 11.

According to claim 1, a holder for holding cleaning tool heads comprising a central section, two latchable folding wings, which are pivotably mounted on the central section, a latching device, which can latch the two folding wings in a pivoted position in relation to the central section and a device for releasing the latching of the latched folding wings in relation to the central section such that the folding wings can be pivoted. In other words, the base plate of the mop is divided into three parts. Firstly, there is a central section lying between the two folding wings. The folding wings can be pivoted about this central section such that it can be pivoted between a first configuration, in which the two folding wings and the central section together form a plane at their underside (flat configuration), and a second configuration, in which the two folding wings together with the central section form a substantially U-shaped form. In the second configuration, a tool head can be mounted on the holder. This tool head is held by pockets provided at its end in the first configuration by the holder and can hence can no longer slip off this unintentionally. The pivotable mounting of the folding wings in relation to the central section can, for example, take place by means of an axial mounting, however, it can also take place in that the folding wings are connected to the central section by means of a flexible connecting piece.

The latching device ensures that the two folding wings can be held in the first configuration, i.e. a position in which the holder forms a flat base plate and does not unintentionally "fold together".

One feature of the present invention is that the latching device is preloaded to the state in which the two folding wings are latched. When the latching is released, this causes the holder automatically to latch the two folding wings by means of the latching device when the two folding wings are moved to a state in which the lower surfaces of the two folding wings are substantially in one plane. In other words, this means that a user does not have to perform a separate action to latch the folding wings if it is wished to transfer them from the U-shaped configuration into the flat configuration. It is sufficient only to pivot the folding wings, which can, for example, be achieved by pressing them against a floor to be cleaned. This causes them to spread outward, which, as described in the claim results in automatic latching. Since this does require any separate latching step in addition to the spreading, it is easy to provide the holder with a new tool head.

According to one preferred embodiment, the latching device comprises a stop on the folding wing for at least one of the folding wings, preferably for both, and a bearing part that is movable in relation to the central section comprising at least one bearing part stop. In this case, on the latching of the folding wing, the stop on the folding wing and the bearing part stop are in engagement with one another, while, when the latching is released due to the movement of the bearing part, they become disengaged. In other words, a bearing part is provided on which the respective folding wing/folding wings can abut on latching. These are securely latched and blocked by the resulting contact with the central section and therefore the base plate of the mop is not deformed or only slightly deformed during use.

It has also been found to be advantageous for the device to comprise a manually actuatable pushbutton in order to release the latching of the folding wings in relation to the central section. When actuated, if the actuation is sufficiently strong, this results in the release of the latching. To enable this, the pushbutton is coupled to the bearing part. On actuation, the pushbutton causes a movement of the bearing part, which, on displacement by a predetermined distance, in turn releases the latching. In other words, there is a pushbutton on the holder, which so to speak enables the release of the latching "on the push of a button". Since said button is coupled to the bearing part, this enables easy release of the latching. Thus, even after lengthy work with the mop, it is possible to remove the tool head easily and without problems since a pushbutton of this kind can be effectively actuated even after lengthy work and the corresponding muscle exhaustion.

In this context, it is advantageous for the bearing part and the pushbutton to be embodied in one piece, i.e. for this to be a single component. This facilitates a simple mop design; a complicated coupling between the bearing part and pushbutton is no longer necessary.

It has been found advantageous for the above-described bearing part stop to be directed downward, particularly if it is directed diagonally downward. Here, the direction "downward" means the direction extending perpendicularly from the side of the holder on which, in the latched state, one plane is formed by the central section and the two folding wings. In other words, it is the side, which, in use, is opposite to a shaft and a handle optionally connected to the holder. Insofar, this is the side of the holder, which, in normal use, lies on the surface to be cleaned. Moreover, the stop is preferably aligned on the folding wing such that, in the latched state of the folding wing, it lies flat on the bearing part stop.

In other words, this means that the bearing part stop at least partially points downward (even if it is preferably inclined). The fact that, in the latched state, the stop on the folding wing preferably lies flat on the bearing part stop means there is good contact between these two stops. Insofar, good latching is ensured. The alignment of the bearing part stops downward, preferably diagonally downward, enables unintentional pivoting of the folding wings to be effectively and reliably prevented.

In addition, preferably the bearing part can be moved substantially parallel to the swivel axle of the folding wing. In particular in this case it is preferable if the bearing part can only be moved substantially parallel to the swivel axle of the folding wing, i.e. that it cannot be moved in another direction at all or can only be moved slightly in another direction. One advantage of this feature per se is that this ensures effective and simple removal of the bearing part. In particular, a cleaner will find it easier after a long period of work to remove a bearing part substantially parallel to the swivel axle of the folding wings than would, for example, be possible along a direction of the shaft.

When combined with the features of claim 2, this would also have the advantage that it prevents unintentional disengagement of the stops that would be possible with mobility in other directions under some circumstances. For example, mobility perpendicular to the swivel axles could result in the bearing part being pressed upward or sideward on the exertion of pressure on the folding wings. However, this could result in the parts in question becoming disengaged, which can result in the slipping off and falling off of the tool head.

It is also advantageous for the swivel axles of all the folding wings to be substantially parallel to one another. This makes it easy to fold the holder and as a result remove the tool head.

With the named embodiments, it is further advantageous for there to be a further device that restricts the pivoting range of at least one or preferably all of the latchable folding wings in the non-latched state. As a result, the pivoting range is restricted such that the folding wings have to enclose a minimum angle with each other. This means that, in non-latched state, they enclose an angle of in each case at least 10°, preferably 20°, more preferably 30° in the downward direction. This is advantageous during use. In other words it is particularly advantageous if the two folding wings enclose an angle of approximately 60°, i.e. approximately 55° to 65°, with each other symmetrically to the downward direction. Thus, this prevents the folding wings folding completely downward after the release of the latching. This would make difficult to provide the holder with a tool head. The fact that the folding wings with the different angles are spread outward enables them to be easily transferred to the flat state of the underside and simultaneously clamp the tool head in that the holder with the folding wings is simply pressed downward against the surface to be cleaned on which the tool head lies. As is evident from the above, this has advantages associated with ease of use.

The named pivoting-range-restricting device advantageously comprises a central section stop which is fixed in relation to the central section. This means that there is a further stop on the central section, which is able to engage with the associated folding wing, particularly preferably the already defined stop of the folding wing, in the non-latched state. This restricts the pivoting range in a simple manner, but simultaneously reliably. The simple design of this device enables the production costs to be reduced.

With the named preferred embodiments, it is also advantageous for the automatic latching to take place in the state in which the lower surfaces of the two latchable folding wings are substantially in one plane. This ensures that the mop can be used in the latched state.

Moreover, preferably a handle is provided on the central section, which can be latched about two axles in relation to the central section and preferably in a rotational position about one axle. As a result, the holder is easy to use under furniture, for example, particularly if a shaft is fixed to the handle.

BRIEF DESCRIPTION OF THE FIGURES

FIG. 1 is an exploded view of a holder according to the present invention.

FIG. 2 shows the assembled holder according to the invention in a latched state.

FIG. 3 shows a partial sectional view of a detail of the holder according to the present invention in the latched state.

FIG. 4 shows a full view of the holder according to the present invention in the non-latched state in a partial sectional view.

FIG. 5 is a detailed view of the holder according to FIG. 4.

FIG. 6 shows a side view of the holder according to the present invention.

DETAILED DESCRIPTION OF THE FIGURES

FIG. 1 is an exploded view of the holder 10 according to the present invention. The assembled holder 10 can be seen in FIG. 2.

This holder 10 comprises a handle 28, which is rotatably mounted on an intermediate part 34. This rotatable or pivotable mounting can be latched in a pivotal position with respect to a swivel axle by means of a latching device 30. The central section 12 is provided on the intermediate part 34 by means of a pivot axle 32. Two folding wings 14 are attached to this central section 12 by means of two axles 22.

Further provided on the central section 12 is a movable pushbutton 20, which is partially accommodated in a groove 13 of the central section 12 on the side of the handle 28. The surfaces of the folding wings 14 and of the central section 12 opposite the handle 28 form the surface, which, when the holder is used in a mop lies together with the tool head attached thereto on the surface to be cleaned.

The pushbutton 20 itself is used to actuate or release the latching device, which will be described in detail later. It is accommodated displaceably is in the groove 13, wherein, however, it is also accommodated in a hollow top unit 21 located on the central section 12 on the side of the groove 13. Insofar, it is accommodated along a circumferential direction by the central section 12, wherein, however, it protrudes from the central section 12. Insofar, it is easy to actuate from outside. The details will be described later.

The two folding wings 14 are flat, plate-like elements with a substantially rectangular, basic shape. On a narrow side of the rectangle, which, when a tool head is held, is on the outside, these have a substantially smooth edge. Projections provided with through-holes are provided on the opposite side which can be connected to the central section 12. Here, the through-holes are aligned such that a through-hole, which extends parallel to the narrow side of the folding wing and which has the same diameter for each projection, is provided in each of the projections. The through-holes are aligned with one another such that a single pivot axle 22 can be guided through these through-holes. These holes are used to connect the respective folding wing 14 to the central section 12.

Of the named projections of the folding wings 14, projection 18*a* deserves a special mention since this plays a role in the latching of the folding wings 14 in relation to the central section 12. This projection 18*a* is provided on a position of the narrow side of the folding wing 14 provided with projections such that it able to penetrate a passage 19 of the central section to be mentioned later. At its longitudinal end, it comprises a beveled surface 18, which in an assembled holder 10 extends diagonally downward.

The central section 12 is a body, which can substantially be described as two-part. On the one hand, there is a flat, rectangular part on the longitudinal sides of which recesses and projections matching the narrow-side projections and recesses of the folding wings 14 are provided. These projections are provided with through-holes which match the through-holes in the folding wings 14 such that rod-like pivot axles 22 can be inserted therethrough and as a result the folding wings 14 are pivotably connected to the central section 12. However, on the central section 12, there is also a hollow top unit 21 that opens toward a narrow side of the central section 12 but substantially closed on the other sides. This top unit 21 is formed in one piece with the lower part and substantially has the shape of a cuboid with rounded corners.

On the side of the outlet 21, which is open, there is a groove 13 with a downward tapering trapezoidal shape in the flat, rectangular part of the central section 12. This groove 13 extends along the longitudinal direction of the flat, rectangular part of the central section 12 from the top unit 21 as far as the end of the central section 12 opposite to the opening of the top unit 21.

Moreover, parallel to the narrow side, i.e. perpendicular to the longitudinal direction of the central section 12, two bore holes 33 extending parallel to the underside of the central section 12 are provided in the top unit 21. These pass through the walls of the hollow space defined by the top unit 21 in alignment with one another.

In the assembled state the pushbutton 20 is inserted in this hollow space. This pushbutton 20 has the shape of a hollow body, which is open on one side. This shape could also be described as a hollow cuboid with one open side. The pushbutton 20 is inserted with this open side opposite the closed side of the top unit 21 in the hollow space of the top unit 21. The pushbutton 20 further comprises in each case on the two sides lying against the holes 33 after insertion in the top unit 21, holes 37 that are in alignment with the holes 33. However, these holes 37 are oblong. After the insertion of the pushbutton 20, the longitudinal direction of these oblong holes 37 is parallel to the longitudinal direction of the central section 12. As a result, an axle 32 can be inserted through the holes 33 and 37 without preventing the displacement of the pushbutton 20 in relation to the top unit 21 along the longitudinal direction of the central section 12.

Between the pushbutton 20 and the closed wall of the top unit 21, a spring 36 is provided, which is used to preload the pushbutton 20 toward the opening of the top unit 21, i.e. this spring presses the pushbutton 20 outward. The spring is, for example, held by corresponding projections in the pushbutton 20 and top unit 21 such that it is not able to slip with respect to these two components. As will be become clear from the later description, the tensioning of the spring 36 is important in that this achieves the automatic latching as already described above.

On the lower side of the pushbutton 20, on insertion in the top unit 21, there is a bearing part 16 with a cross section in the shape of a downward-tapering trapezium perpendicular to the longitudinal direction of the central section 12. The shape of this trapezium fits in the groove 13, i.e. this projection can be inserted in the groove 13 and displaced in this groove 13 along the longitudinal direction of the central section 12. Inside the central section 12, in which the region the top unit 21 is located, there is a passage 19, into which the assembled holder 10 a correspondingly dimensioned projection 18*a* of the folding wings is inserted. This passage 19 is dimensioned such that, with a corresponding longitudinal position of the pushbutton 20, the projection 18*a* can come into contact with the bearing part 16 through this. I.e. this passage opening 19 enables, in addition to the opening in the top unit 21 already mentioned, further access to the interior of the top unit 21. The passage opening 19 also divides the flat rectangular part of the central section 12 into two parts and at the same time extends substantially parallel to the narrow sides of the flat rectangular part. These two parts are held together by the top unit 21.

An intermediate part 34 is placed on the top of the top unit 21, i.e. on the side opposite the underside of the holder 10. This intermediate part 34 comprises two arms 35 each with a bore hole. This bore hole enables it to be connected to the top unit 21 and the pushbutton 20. To be more precise, the axle 32 is introduced through the bore hole of one the arms 35 of the intermediate part 34. It then passes through the hole 33 in the top unit 21 and through one of the holes 37 of the pushbutton 20. It then passes through the other hole 37 of the pushbutton 20 and through the associated hole 33 of the top unit 21 in order finally to penetrate the other hole of the other arm 35 of the intermediate part 34. This connects the intermediate part 34, the central section 12 and the pushbutton 20. In particular, this can prevent the pushbutton 20 being pushed out of the top unit 21 by the force of the spring 36 since the boundary of the hole 37 lies on the axle 32 and hence prevents pushing out by the tension force of the spring 36. Insofar, the axle 32 is not only responsible for ensuring a pivotable connection between the handle 28 and the holder 10, it is also used to prevent the pushbutton 20 from sliding out.

In the intermediate part 34, there is a further hole 34*a*, via which the handle 28 is pivotably mounted in relation to the intermediate part 34.

For a better understanding of the latching mechanism, we will now discuss FIG. 3 in detail. This figure does not contain all the reference numbers used in FIGS. 1 and 2 in order to ensure it is not difficult to understand.

FIG. 3 shows a partial sectional view of the holder 10, which is enlarged compared to FIG. 2, in the latched state. In the latched state, the lower sides the folding wings 14 and of the central section 12 substantially form one plane. The tension force of the spring 36 forces the pushbutton 20 as far outward as possible, i.e. until the edges of its holes 37 opposite the opening of the top unit 21 lie on the axle 32 and consequently prevent a further outward movement of the pushbutton 20. In such a state, the bearing part 16 is located inside the passage 19. This enables interaction with the projections 18*a* of the folding wings 14.

Specifically, this means that a surface (stop) 18 of the folding wing 14 is in engagement with the side areas (bearing part stop) 17 of the bearing part 16. In other words, the stops 18 of the folding wing 14 and the trapezoidal limb surfaces of the bearing part 16 lie flat on one another such that downward-pivoting of the folding wings 14 is prevented. In this state it is, however, possible to push the pushbutton 20 into the top unit 21 by manual actuation. This causes the bearing part 17 to move out of the passage opening 19. However, this means the stops 18 and bearing part stops 17 are no longer able to engage. This has the result that the latching is released and, as a result, the folding wings 14 can be pivoted.

However, this pivoting is restricted by the upper part of the passage 26 forming the central section stops 26. The surfaces 18 lie against these when the maximum pivoting of the folding wings 14 is achieved and hence prevent further pivoting.

Insofar, the bearing part stops 17 of the bearing part 16 together with the surfaces 18 the projections 18*a* form the latching device. In the latched state, the surfaces 17 and 18*a* lie flat on one another. Since, in the latched state, the surfaces 17, and correspondingly the surfaces 18 are directed diagonally downward, the projections 18*a* cannot be pivoted upward. Furthermore, a similar arrangement also prevents downward-pivoting of the projections 18*a*. This has the result that the part of the folding wings 14 that extends outward from the pivot axles 22 cannot be moved downward in the latched state. Insofar, in this state, pivoting the folding wings 14 is prevented, hence as far as the positioning of the folding wings 14 in relation to the central section 12 is concerned, the holder is latched. If, as is the case here, it is ensured that the lower surfaces of the folding wings 14 and the central section 12 form a plane, the holder can be effectively used for holding tool heads and hence for cleaning surfaces without any substantial deformation of the holder 10.

If, however the pushbutton 20 is pressed in sufficiently deeply, the state shown in FIG. 4 which is also shown in FIGS. 5 and 6, is achieved. In this case, the pushbutton 20 has been pushed in so strongly that the bearing part 16 has been completely removed from the passage 19 and hence releases this. Since this means that a bearing between the surfaces 18 and 17 is no longer possible, there is no longer any latching, i.e. the projections 18*a* can also be pivoted upward. Hence, the latching is released. Since the length of the folding wings 14 outside the pivot axles 22 is much greater than the length between them, with a typical use of the holder 10 in a mop, due to the force of gravity, this would have the result that that the folding wings 14 fold downward automatically since they are now no longer prevented from doing so by the latching. Insofar, the folding wings 14 fold together and a tool head present can be easily removed as long as it has not already automatically removed itself from the holder.

Simultaneously, the spring 36 prevents the pushbutton 20 from being pushed out since the projections 18 now lie on their surface opposite to the opening of the top unit 21 on a corresponding surface of the bearing part 16 (see FIG. 5). This bearing prevents the pushbutton 20 being pushed out by the spring 36. Insofar, the pushbutton 20 remains in its pressed-in state, which is also evident from FIG. 6 (particularly in comparison to FIG. 2). However, if the two folding wings 14 are returned to the latched state, as shown, for example in FIG. 2, this engagement is released. The tension force of the spring 36 then forces the pushbutton 20 out and automatically, i.e. without external intervention on the part of a user, results in a latching of the folding wings 14 in relation to the central section 12. This ensures simple latching of the holder 10.

The invention claimed is:

1. A holder for holding cleaning tool heads, particularly mop heads, comprising a central section, two latchable folding wings, which are pivotably mounted on the central section, a latching device to latch the two folding wings in a pivoted position in relation to the central section and a releasing device for releasing the latching of the latched folding wings in relation to the central section such that the folding wings can be pivoted, wherein the releasing device further comprises a pushbutton element in the central section, wherein upon depression of the pushbutton when the folding wings are latched in the pivot position, the folding wings are no longer in a latched position, wherein the latching device is preloaded to a state in which the two folding wings are latched in such a manner that, when the latching is released, the holder automatically latches the folding wings by means of the latching device when the two folding wings are moved to a state in which lower surfaces of the two folding wings are substantially in one plane, wherein the latching device comprises a stop on at least one folding wing, and a bearing part that is movable in relation to the central section comprising at least one bearing part stop, wherein, on the latching of the folding wing, the stop on the folding wing and the bearing part stop are engaged with one another, and when the latching is released due to movement of the bearing part, they become disengaged, wherein the bearing part is movable parallel to a pivot axle of the folding wing, and wherein the latching device comprises a stop on both folding wings.

2. The holder according to claim 1, wherein the device for releasing the latching of the folding wings in relation to the central section comprises a manually actuatable pushbutton that releases the latching when actuated, wherein the pushbutton is coupled to the bearing part, and wherein, on actuation, the pushbutton moves the bearing part and, on actuation for a predetermined distance, releases the latching of the folding wings.

3. The holder according to claim 2, wherein the bearing part and the pushbutton are embodied in one piece.

4. The holder according to claim 2, wherein the bearing part stop is directed downward, and wherein the stop on the folding wing is aligned on the folding wing such that, in a latched state of the folding wing, it lies flat on the bearing part stop.

5. The holder of claim 2 wherein the bearing part stop is directed diagonally downward.

6. The holder according to claim 1, wherein pivot axles of both folding wings are substantially parallel to one another.

7. The holder according to claim 1, further comprising a device which restricts the pivoting range of at least one of the latchable folding wings in a non-latched state, wherein the device is designed such that the lower surface of at least one of the latchable folding wings in the non-latched state, encloses an angle of at least 10°, in a downward direction, measured in projection along the respective associated pivot axle.

8. The holder according to claim 7, wherein, to restrict the pivoting range the device comprises a central section stop, which is provided fixed in relation to the central section, which may be brought into engagement with the associated folding wing to restrict the pivoting range of the latchable folding wings.

9. The holder of claim 8 wherein the central section stop is brought into engagement with a stop of the folding wing to restrict its pivoting range.

10. The holder of claim 7 wherein the device restricts the pivoting range of both latchable folding wings.

11. The holder of claim 7 wherein the device is designed such that the lower surface of at least one of the latchable folding wings enclose an angle of at least 30° in a downward direction.

12. The holder of claim 7 wherein the device is designed such that the lower surfaces of both folding wings enclose an angle of at least 10° in a downward direction.

13. The holder according to claim 1, wherein latching takes place in a state in which the lower surfaces of the two latchable folding wings are substantially in one plane.

* * * * *